US005204198A

United States Patent [19]

Bugner et al.

[11] Patent Number: 5,204,198

[45] Date of Patent: Apr. 20, 1993

[54] PHOTOELECTROGRAPHIC ELEMENTS UTILIZING NONIONIC SULFONIC ACID PHOTOGENERATORS

[75] Inventors: Douglas E. Bugner; Jeanne E. Kaeding; Michel F. Molaire, all of Rochester, N.Y.

[73] Assignee: Eastman Kodak Company, Rochester, N.Y.

[21] Appl. No.: 783,590

[22] Filed: Oct. 28, 1991

[51] Int. Cl.[5] ..... G03G 13/16; G03G 13/22

[52] U.S. Cl. ..... 430/49; 430/69; 430/73; 430/83; 430/96; 430/126

[58] Field of Search ..... 430/70, 280, 96, 49, 430/69, 73, 126

[56] References Cited

U.S. PATENT DOCUMENTS

| | | | |
|---|---|---|---|
| 3,081,165 | 3/1963 | Ebert | 96/1 |
| 3,512,966 | 5/1970 | Shattuck et al. | 96/1 |
| 3,600,169 | 8/1971 | Lawton | 96/1.5 |
| 3,859,089 | 1/1975 | Chambers | 96/1.4 |
| 3,879,197 | 4/1975 | Bartlett et al. | 96/1.4 |
| 3,879,201 | 4/1975 | Williams et al. | 96/1.6 |
| 3,982,935 | 9/1976 | Bartlett et al. | 96/1 R |
| 4,033,769 | 6/1977 | Williams et al. | 96/1.5 |
| 4,111,692 | 9/1978 | Etoh et al. | 96/1 R |
| 4,371,605 | 2/1983 | Renner et al. | 430/280 |
| 4,661,429 | 4/1987 | Molaire et al. | 430/70 |

FOREIGN PATENT DOCUMENTS

| | | |
|---|---|---|
| 51-013242 | 2/1976 | Japan . |
| 51-013245 | 2/1976 | Japan . |
| 58-139159 | 8/1983 | Japan . |
| 58-139160 | 8/1983 | Japan . |

OTHER PUBLICATIONS

G. Berner, et al., Latent Sulphonic Acids, 10 Journal of Radiation Curing 10–23 (Oct. 1986).

Buhr, et al., Non-Ionic Photoacid Generating Compounds, 61 Polym. Mater. Sci. Eng. 269–277 (1989).

*Primary Examiner*—John Goodrow

*Attorney, Agent, or Firm*—Michael L. Goldman; William T. French; Willard G. Montgomery

[57] ABSTRACT

The present invention relates to a photoelectrographic element having a conductive layer in electrical contact with an acid photogenerating layer which is free of photopolymerizable materials and contains an electrically insulating binder and a nonionic sulfonic acid photogenerator. A method of forming images with this element is also disclosed.

22 Claims, No Drawings

PHOTOELECTROGRAPHIC ELEMENTS UTILIZING NONIONIC SULFONIC ACID PHOTOGENERATORS

FIELD OF THE INVENTION

This invention relates to photoelectrographic elements and an imaging method of exposing such elements with actinic radiation.

BACKGROUND OF THE INVENTION

Electrographic imaging processes and techniques have been extensively described in patents and other literature. These processes may take the form of electrophotographic techniques whereby a photoconductive insulating material is first electrostatically charged and then imagewise exposed with light to form a latent image. Exemplary electrophotographic imaging processes are disclosed in U.S. Pat. Nos. 2,221,776; 2,277,013; 2,297,691; 2,357,809; 2,551,582; 2,825,814; 2,833,648; 3,220,324; 3,220,831; 3,220,833 and many others.

Electrographic imaging processes may also take the form of photoelectrographic techniques whereby a photoconductive insulating material is first imagewise exposed to form a persistent latent conductivity pattern from which multiple prints may be obtained by electrostatically charging and developing the persistent conductivity pattern using a variety of known electrostatic printing techniques. These processes have the advantage of requiring only a single light exposure that will produce many prints. This reduces both the time and cost of electrostatic reproduction. Exemplary photoelectrography processes such as that described above are disclosed in U.S. Pat. Nos. 3,879,197; 3,982,935; 3,512,966; 3,081,165; 4,033,769; 3,879,201; 3,859,089 and 4,661,429.

Acid photogenerators are known for use in photoelectrographic processes. For example, U.S. Pat. No. 3,879,197 to Bartlett, et al., describes an imaging process utilizing a material capable of forming a hydrohalide acid upon imagewise exposure to activating radiation. However, the hydrohalide acids formed in the Bartlett, et al., process are always used in conjunction with certain other organic addenda, tend to be somewhat volatile, and possess relatively low levels of conductivity.

In U.S. Pat. No. 4,661,429 to Molaire, et al., a photoelectrographic method is disclosed that utilizes a photoelectrographic element containing onium salt acid photogenerators. The method disclosed by Molaire takes advantage of the fact that exposure of the acid photogenerator significantly increases the charge decay in the exposed area of the layer. Imagewise irradiation of acid photogenerator layer will therefore create a differential charge decay between exposed and unexposed areas when coupled with electrostatic charging. The differential charge decay will create an electrostatic image that may be developed using known electrostatic printing processes.

Although the photoelectrographic elements of Molaire, et al., exhibit superior performance compared to many of the known photoelectrographic elements, they suffer from the disadvantage that they are sensitive to variation in the moisture content of the surrounding atmosphere. For example, as the relative humidity in the surrounding atmosphere increases, the photoelectrographic elements of Molaire, et al., become more conductive. Conversely, as the relative humidity in the surrounding atmosphere decreases, they become less conductive and more insulating. This change in conductivity is observed in exposed and unexposed areas of the photoelectrographic element to differing extents depending upon the specific formulation of the element.

For example, at high relative humidities, unexposed areas of a particular element cannot be charged adequately. As a result, the potential difference between exposed and unexposed areas will not yield a toned image of acceptable contrast. Conversely, at low relative humidity conditions, exposed areas of other photoelectrographic elements may not discharge to a level far enough below that retained on the unexposed areas of the element. Therefore, the difference in potential available for toning is again too small to yield images of acceptable contrast and quality. In sum, while a given formulation may perform adequately at some conditions, its electrical performance may change significantly in response to changes in relative humidity such that image quality becomes unacceptable.

Accordingly, it is an object of this invention to provide a photoelectrographic element that will not only provide persistent activity with good contrast and quality relative to each print but is also substantially insensitive to the widely varying changes in relative humidity which are encountered during normal photoelectrographic operating conditions.

SUMMARY OF THE INVENTION

The present invention relates to a photoelectrographic element comprising a conductive layer in electrical contact with an acid photogenerating layer. The acid photogenerating layer, in accordance with the present invention, is free of photopolymerizable materials and includes an electrically insulating binder and a nonionic sulfonic acid photogenerating compound. It has been unexpectedly found that the use of non-ionic, sulfonic acid photogenerators not only provides persistent activity with high quality imaging, but also exhibits excellent performance when exposed to widely varying relative humidities.

The present invention also provides a photoelectrographic imaging method which utilizes the above-described photoelectrographic element. This process comprises the steps of exposing the acid photogenerating layer imagewise to near-infrared radiation without prior charging to create a latent conductivity pattern and printing by a sequence comprising: charging to create an electrostatic latent image, developing the electrostatic latent image with charged toner particles, transferring the toned image to a suitable receiver, and cleaning any residual, untransferred toner from the photoelectrographic element.

The imaging method and elements of the present invention use acid photogenerators in thin layers coated over a conductive layer to form images. This imaging technique or method takes advantage of the discovery that exposure of the acid photogenerator significantly increases the conductivity in the exposed area of the layer. Imagewise irradiation of the acid photogenerator layer creates a persistent differential conductivity between exposed and unexposed areas. This allows for the subsequent use of the element for printing multiple copies from a single exposure with only multiple charging, developing, transferring, and cleaning steps. This is different from electrophotographic imaging techniques where the electrophotographic element must generally be charged electrostatically followed by imagewise exposure for each copy produced. As a result, maximum throughput tends to be limited, and energy consumption is likely to be greater.

As noted above, the use of nonionic sulfonic acid photogenerators realizes all the advantages of a persistent photoelectrography system and also provides an element or process that will perform well in widely varying relative humidity conditions that are commonly encountered.

DETAILED DESCRIPTION OF THE INVENTION

As noted above, the present invention relates to a photoelectrographic element comprising a conductive layer in electrical contact with an acid photogenerating layer which is free of photopolymerizable materials and includes an electrically insulating binder and a sulfonic acid photogenerator.

In preparing the acid photogenerating layer, the acid photogenerator and the electrically insulating binder are co-dissolved in a suitable solvent and the resulting solution is coated over the electrically conductive support.

Solvents of choice for preparing acid photogenerator coatings include a number of solvents including aromatic hydrocarbons such as toluene; ketones, such as acetone or 2-butanone; esters such as acetate or methyl acetate; chlorinated hydrocarbons such as ethylene dichloride, trichloroethane, and dichloromethane; ethers such as tetrahydrofuran; or mixtures of these solvents.

The acid photogenerating layer may be coated on a conductive support using any of the methods well-known in the art. Useful coating methods include doctor-blade coating, swirling, dip-coating, and the like.

The nonionic acid photogenerators used in the element of the present invention are known as nonionic sulfonic acid photogenerators. For purposes of this invention, a nonionic sulfonic acid photogenerator is a compound that, upon exposure to actinic radiation, undergoes a photolytic reaction that produces a sulfonic acid. A sulfonic acid is any organic compound containing the radical $—SO_2OH$.

Examples of nonionic sulfonic acid photogenerators are disclosed in G. Berner *Latent Sulphonic Acids*, J. Radiation Curing, pp. 10–23 (October 1986) and G. Buhr, et al., *Non-ionic Photoacid Generating Compounds*, Polym. Mater. Sci. Eng. 61, pp. 269–277 (1989) and are incorporated by reference into this specification.

Preferred nonionic sulfonic acid photogenerators are the sulfonate esters of the N-hydroxyamides and the N-hydroxyimides as disclosed in U.S. Pat. No. 4,371,606 to Renner, the disclosure of which is incorporated herein by reference. Although any sulfonate ester of an N-hydroxyamide or an N-hydroxyimide may be useful as the photoactive substance of the photoelectrographic element of the present invention, a preferred class of sulfonic acid photogenerators comprise the sulfonate esters of N-hydroxyamide or N-hydroxyimide having the following respective generic structures:

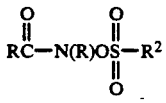

and

-continued

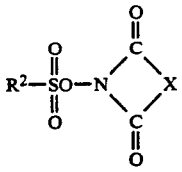

wherein:

$R^2$ is an n-valent aliphatic, cycloaliphatic, or aromatic group, preferably a $C_1$–$C_{10}$ hydrocarbon radical or a substituted $C_1$–$C_{10}$ hydrocarbon radical with substituents selected from F, Cl, Br, $NO_2$, CN, $—^+N(CH_3)_3$, $C_6H_5$, $C_6F_5$, and $OCH_3$. A particularly preferred $R^2$ group is trifluoromethyl.

R is an aliphatic, cycloaliphatic, and aromatic group, preferably an aryl group (e.g. phenyl, naphthyl or anthryl) or a substituted aryl of 6–14 carbon atoms. Preferred substituents include $C_1$–$C_4$ alkyl groups, Cl, Br, F, $OCH_3$, $OC_2H_5$, CN, $NO_2$, $—^+N(CH_3)_3$, $C_6H_5CO—$, $OC_2C_6H_5$, $OCF_3$, and $C_6H_5$.

$R^1$ is H, an aliphatic or cycloaliphatic organic group or

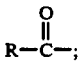

Preferably, $R^1$ is H, an alkyl of 1–4 carbon atoms, or

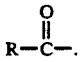

X, when combined with

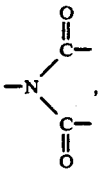

forms a 5–7 membered ring which can contain one or more additional hetero atoms such as nitrogen or oxygen, or additional fused rings such as benzene, naphthalene, anthracene, or other aromatic species. Preferably, the 5–7 membered ring includes only one nitrogen atom and no other hetero atoms.

Examples of suitable 5–7 membered rings comprising

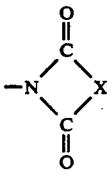

include the following:

-continued

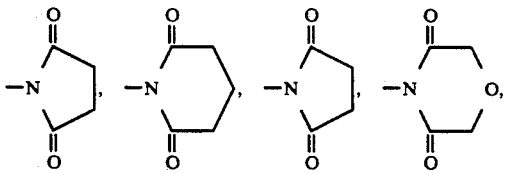

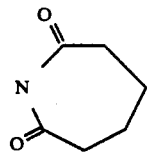

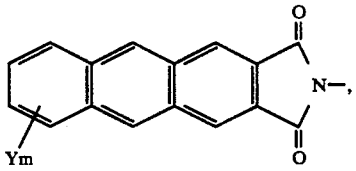

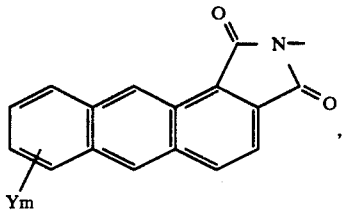

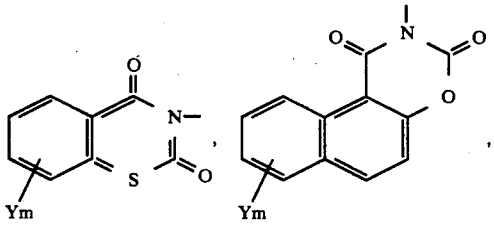

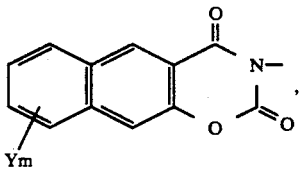

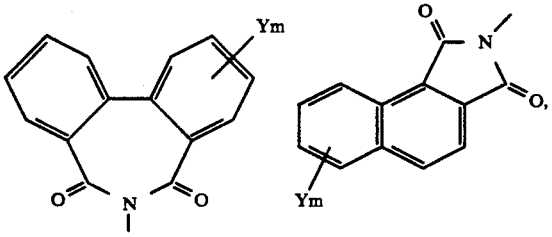

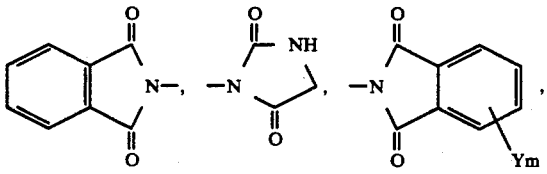

-continued

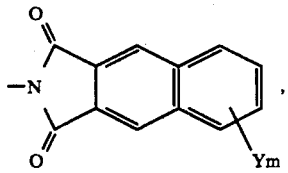

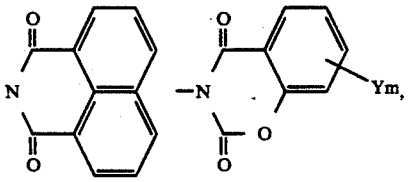

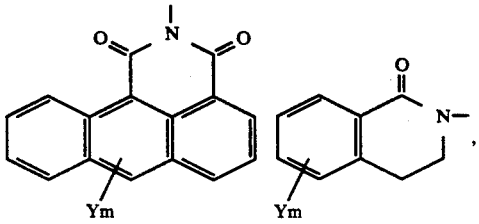

and

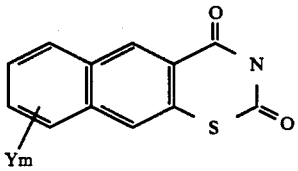

In the above structures, m is an integer from 0–4 and Y is a $C_1$–$C_4$ alkyl, Cl, $NO_2$, Br, F, $OCH_3$, $OC_2H_5$, OH, CN, $C_6H_5$, $OCH_2C_6H_5$, $CF_3$, or $-^+N(CH_3)_3$.

Especially useful as the acid photogenerator of the present element are phthalimidyl trifluoromethanesulfonates (also known as phthalimidyl triflates) such as N-(1,8-naphthalimidyl) triflate, phthalimidyl triflate, and N-(3-methylphthalimidyl) triflate.

The acid photogenerating material should be selected to impart little or no conductivity before irradiation, with the conductivity increasing after exposure. Useful results are obtained when the coated layer contains at least about 1 weight percent of the nonionic sulfonic acid photogenerator. The upper limit of acid photogenerator is not critical as long as the photogenerator does not adversely affect the initial conductivity of the film. A preferred weight range for the acid photogenerator in the coated and dried composition is from 15 weight percent to about 40 weight percent.

The thicknesses of the acid photogenerator layer can vary widely with dry coating thicknesses ranging from about 0.1 μm to about 50 μm, although coating thicknesses outside these limits may also be useful.

Useful electrically insulating binders for the acid photogenerating layers include polycarbonates, polyesters, polyolefins, phenolic resins, and the like. Desirably, the binders are film forming. Such polymers should be capable of supporting an electric field in excess of $1\times10^5$ V/cm (preferably, $1\times10^6$ V/cm) and exhibit a low dark decay of electrical charge.

Preferred binders are styrene-butadiene copolymers; silicone resins; styrene-alkyd resins; soya-alkyd resins;

poly(vinyl chloride); poly(vinylidene chloride); vinylidene chloride, acrylonitrile copolymers; poly(vinyl acetate); vinyl acetate, vinyl chloride copolymers; poly(vinyl acetals), such as poly(vinyl butyral); polyacrylic and methacrylic esters, such as poly(methyl methacrylate), poly(n-butyl methacrylate), poly(isobutyl methacrylate), etc.; polystyrene; nitrated polystyrene; poly(vinylphenol)polymethylstyrene; isobutylene polymers; polyesters, such as phenol formaldehyde resins; ketone resins; polyamides; polycarbonates; etc. Methods of making resins of this type have been extensively described in the prior art. For example, styrene-alkyd resins can be prepared according to the method described in U.S. Pat. Nos. 2,361,019 and 2,258,423. Suitable resins of the type contemplated for use in the photoactive layers of this invention are sold under such tradenames as Vitel PE 101-X, Cymac, Piccopale 100, Saran F-220. Other types of binders which can be used include such materials as paraffin, mineral waxes, etc.

Particularly preferred binders for use in the element of the present invention are aromatic esters of polyvinyl alcohol polymers and copolymers, as disclosed in pending U.S. patent application Ser. No. 509,119, entitled "Photoelectro-graphic Elements." Binders of this class include:

poly(vinyl benzoate),
poly(vinyl 2-naphthoate),
poly(vinyl benzoate-co-vinyl acetate),
poly(vinyl 2-naphthoate-co-vinyl acetate),
poly(vinyl 1-naphthoate-co-vinyl acetate),
poly(vinyl cinnamate),
poly(vinyl 5-phenyl-2,4-pentadienoate),
poly(vinyl cinnamate-co-vinyl 1-naphthoate),
poly(vinyl p-chlorobenzoate-co-vinyl acetate),
poly(vinyl m-chlorobenzoate-co-vinyl acetate),
poly(vinyl o-chlorobenzoate-co-vinyl acetate),
poly(vinyl p-bromobenzoate-co-vinyl acetate),
poly(vinyl m-bromobenzoate-co-vinyl acetate),
poly(vinyl o-bromobenzoate-co-vinyl acetate),
poly(vinyl p-iodobenzoate-co-vinyl acetate),
poly(vinyl m-iodobenzoate-co-vinyl acetate),
poly(vinyl o-iodobenzoate-co-vinyl acetate),
poly(vinyl p-fluorobenzoate-co-vinyl acetate),
poly(vinyl m-fluorobenzoate-co-vinyl acetate),
poly(vinyl o-fluorobenzoate-co-vinyl acetate),
poly(vinyl 5-bromo-2-naphthoate-co-vinyl acetate),
poly(vinyl 4-bromo-1-naphthoate-co-vinyl acetate),
poly(vinyl 5-bromo-1-naphthoate-co-vinyl acetate),
poly(vinyl 2,4-dichlorobenzoate-co-vinyl acetate),
poly(vinyl 3-bromobenzoate-co-vinyl acetate-co-vinyl alcohol),
poly(vinyl p-acetoxybenzoate-co-vinyl acetate),
poly(vinyl m-acetoxybenzoate-co-vinyl acetate),
poly(vinyl o-acetoxybenzoate-co-vinyl acetate),
poly(vinyl 3-acetoxybenzoate-co-vinyl acetate-co-vinyl alcohol),
poly(vinyl p-methylbenzoate-co-vinyl acetate),
poly(vinyl m-ethylbenzoate-co-vinyl acetate),
poly(vinyl p-propylbenzoate-co-vinyl acetate),
poly(vinyl 3-butylbenzoate-co-vinyl acetate-co-vinyl alcohol),
poly(vinyl p-methoxybenzoate-co-vinyl acetate),
poly(vinyl m-ethoxybenzoate-co-vinyl acetate),
poly(vinyl o-propoxybenzoate-co-vinyl acetate),
poly(vinyl 3-butoxybenzoate-co-vinyl acetate-co-vinyl alcohol), and the like.

The binder is present in the element in a concentration of 30 to 98 weight percent, preferably 55 to 80 weight percent.

Useful conducting layers include any of the electrically conducting layers and supports used in electrophotography. These include, for example, paper (at a relative humidity above about 20 percent); aluminum paper laminates; metal foils, such as aluminum foil, zinc foil, etc.; metal plates, such as aluminum, copper, zinc, brass, and galvanized plates; regenerated cellulose and cellulose derivatives; certain polyesters, especially polyesters having a thin electroconductive layer (e.g., cuprous iodide) coated thereon; etc.

While the acid photogenerating layers of the present invention can be affixed, if desired, directly to a conducting substrate or support, it may be desirable to use one or more intermediate subbing layers between the conducting layer or substrate and the acid photogenerating layer to improve adhesion to the conducting substrate and/or to act as an electrical and/or chemical barrier between the acid photogenerating layer and the conducting layer or substrate.

Such subbing layers, if used, typically have a dry thickness in the range of about 0.1 to about 5 μm. Useful subbing layer materials include film-forming polymers such as cellulose nitrate, polyesters, copolymers or poly(vinyl pyrrolidone) and vinylacetate, and various vinylidene chloride-containing polymers including two, three and four component polymers prepared from a polymerizable blend of monomers or prepolymers containing at least 60 percent by weight of vinylidene chloride. Other useful subbing materials include the so-called tergels which are described in Nadeau et al, U.S. Pat. No. 3,501,301.

Optional overcoat layers are useful with the present invention, if desired. For example, to improve surface hardness and resistance to abrasion, the surface layer of the photoelectrographic element of the invention may be coated with one or more organic polymer coatings or inorganic coatings. A number of such coatings are well known in the art and accordingly an extended discussion thereof is unnecessary. Several such overcoats are described, for example, in *Research Disclosure, "Electrophotographic Elements, Materials, and Processes"*, vol. 109, page 63, paragraph V, May, 1973, which is incorporated herein by reference.

In some cases, it may be desirable to incorporate a near-ultraviolet radiation (250 to 450 nm) absorbing sensitizer in the photoelectrographic element. The amount of near-ultraviolet radiation absorbing sensitizer used varies widely, depending upon the type and thickness of the acid photogenerator used as well as the particular sensitizer used. Generally, the near-ultraviolet radiation absorbing sensitizer can be present in an amount of up to about 10 percent by weight of the dried film. The preferred concentration of the UV sensitizer is from about 3 to about 7 weight percent of the dried film.

Useful near-ultraviolet radiation absorbing sensitizers include ketones such as xanthones, indandiones, indanones, thioxanthones, acetophenones, benzophenones, or other aromatic compounds such as anthracenes, dialkoxyanthracenes, perylenes, pyrenes, phenothiazines, etc. Especially useful near-UV sensitizers are anthracenes substituted at the 9 and 10 positions with electron-donating substituents such as 9,10-diethoxyanthracene.

The photoelectrographic elements of the present invention are employed in the photoelectrographic process summarized above. This process involves a 2-step sequence—i.e., an exposing phase followed by a printing phase.

In the exposing phase, the acid photogenerating layer is exposed imagewise to actinic radiation without prior charging to create a latent conductivity pattern. Once the exposing phase is completed, a persistent latent conductivity pattern exists on the element, and no further exposure is needed. The element may then be subjected to the printing phase either immediately or after some period of time has passed.

In the printing phase, the element is given a blanket electrostatic charge, for example, by passing it under a corona discharge device, which uniformly charges the surface of the acid photogenerator layer. The charge is dissipated by the layer in the exposed areas, creating an electrostatic latent image. The electrostatic latent image is developed with charged toner particles, and the toned image is transferred to a suitable receiver (e.g., paper). The toner particles can be fused either to a material (e.g., paper) on which prints are actually made or to an element to create an optical master or a transparency for overhead projection. Any residual, untransferred toner is then cleaned away from the photoelectrographic element.

The toner particles are in the form of a dust, a powder, a pigment in a resinous carrier, or a liquid developer in which the toner particles are carried in an electrically insulating liquid carrier. Methods of such development are widely known and described as, for example, in U.S. Pat. Nos. 2,296,691, 3,893,935, 4,076,857, and 4,546,060.

By the above-described process, multiple prints from a single exposure can be prepared by subjecting the photoelectrographic element only once to the exposing phase and then subjecting the element to the printing phase once for each print made.

The photoelectrographic layer can be developed with a charged toner having the same polarity as the latent electrostatic image or with a charged toner having a different polarity from the latent electrostatic image. In one case, a positive image is formed. In the other case, a negative image is formed. Alternatively, the photoelectrographic layer can be charged either positively or negatively, and the resulting electrostatic latent images can be developed with a toner of given polarity to yield either a positive or negative appearing image.

EXAMPLES

In the examples which follow, the preparation of representative materials, the formulation of representative film packages, and the characterization of these films are described. These examples are provided to illustrate the usefulness of the compounds and electrographic elements of the present invention and are by no means intended to exclude the use of other compounds or elements which fall under the generic description outlined above, or to exclude similar compounds or elements which would be obvious to those skilled in the art.

The coatings described below were all prepared by either hand-coating or machine-coating techniques. In either case, the support comprises a flexible polyester base which is overcoated with (a) cuprous iodide (3.4 weight percent) and poly(vinyl formal) (0.3 weight percent) in acetonitrile (96.3 weight percent), and (b) cellulose nitrate (6 weight percent) in 2-butanone (94 weight percent) over (a). Hand coatings were carried out by drawing the experimental coating solutions over the above support with a doctor blade such that the thickness of the dried films were between 5 and 15 microns. Machine coatings were performed by pumping the experimental solutions through an extrusion hopper (5 mil slot width) onto the moving support (20 ft/min). Dried film thicknesses between 5 and 15 microns were achieved by adjusting the pump speed. The actual thicknesses of the dried films were ascertained by photomicroscopy at 2500× of cross-sections of the dried film.

The performance of the films was evaluated as follows. Two samples, approximately 1.5 by 13 inches, were cut from each film. Each sample was exposed using a 500 watt mercury arc lamp, with a total exposure of ca. 3 joules/cm$^2$. One of the samples was equilibrated for two hours at 70° F. and 70% relative humidity, and the other sample was equilibrated for two hours at 70° F. and 30% relative humidity. Each sample was then evaluated by mounting it in electrical contact with a metal drum, and rotating the drum past a corona charger and an electrostatic voltmeter. The configuration is such that a given area of the film passes in front of the charger and the voltmeter once every second, with the time between the charger and the voltmeter being about 200 milliseconds. The grid potential on the charger is set at +700 V with 0.4 milliamps current. The voltmeter measures the surface potential on both the exposed an unexposed regions of the film on each cycle. It has been shown that after about 28 cycles past the charger, the voltage readings at various points along the length of the film sample become constant from cycle to cycle. The data was therefore reported for the 28th cycle, i.e., under equilibrium conditions.

EXAMPLE 1

A solution comprising 3.0 weight percent N-(3-methylphthalimidyl) triflate, 0.6 weight percent 9,10-diethoxyomthracene (DEA), 8.4 weight percent poly(-vinyl benzoate-co-vinyl acetate (88/12)), and 88.0 weight percent dichloromethane was machine-coated over the support described above. The dried film was 10 microns thick. The performance of this film is summarized in Table I.

EXAMPLE 2

A solution comprising 4.5 weight percent N-(3-methylphthalimidyl) triflate, 0.75 weight percent DEA, 9.75 weight percent poly(vinyl benzoate-co-vinyl acetate (88/12)), and 85 weight percent dichloromethane was hand-coated using a 5 mil blade over the support described above. The dried film thickness was 12 microns. The performance of this film is summarized in Table I.

EXAMPLE 3

A solution comprising 4.5 weight percent phthalimidyl triflate, 0.75 weight percent DEA, 9.75 weight percent poly(vinyl benzoate-co-vinyl acetate (88/12)), and 85 weight percent dichloromethane was hand-coated using a 5 mil blade over the support described above. The dried film thickness was 11 microns. The performance of this film is summarized in Table I.

EXAMPLE 4

A solution comprising 3.0 weight percent N-(3-methylphthalimidyl) triflate, 0.5 weight percent DEA, 6.5 weight percent poly(4,4'-(2-norbornylidene)bisphenolterephthalate-co-azelate), and 90 weight percent dichloromethane was hand-coated using a 6 mil blade over the support described above. The dried film thickness was 10 microns. The performance of this film is summarized in Table I.

EXAMPLE 5

A solution comprising 3.0 weight percent phthalimidyl triflate, 0.5 weight percent (DEA), 6.5 weight percent poly(4,4'-(2-norbornylidene)bisphenolterephthalate-co-azelate, and 90 weight percent dichloromethane was hand-coated using a 6 mil blade over the support described above. The dried film thickness was 12 microns. The performance of this film is summarized in Table I.

EXAMPLE 6

A solution comprising 3.0 weight percent N-(3-methylphthalimidyl) triflate, 0.5 weight percent DEA, 6.3 weight percent bisphenol-A polycarbonate, 0.2 weight percent of an adhesion promoter comprising a polyester of terphthalic acid (100 parts), ethylene glycol (55 parts), and neopentyl glycol (45 parts), and 90 weight percent dichloromethane was hand-coated using a 5 mil blade over the support described above. The dried film thickness was 8.4 microns. The performance of this film is summarized in Table I.

EXAMPLE 7

A solution comprising 3.0 weight percent phthalimidyl triflate, 0.5 weight percent DEA, 6.3 weight percent bisphenol-A polycarbonate, 0.2 weight percent of an adhesion promoter comprising a polyester or terphthalic acid (100 parts), ethylene glycol (55 parts), and neopentyl glycol (45 parts), and 90 weight percent dichloromethane was hand-coated using a 5 mil blade over the support described above. The dried film thickness was 7.5 microns. The performance of this film is summarized in Table I.

COMPARATIVE EXAMPLE 1 (C1)

A film was prepared in the same manner as described in Example 1, except that di-(t-butylphenyl)iodonium triflate is substituted for N-(3-methylphthalimidyl) triflate. Di-(t-butylphenyl)iodonium triflate is a representative onium salt acid photogenerator as disclosed in U.S. Pat. No. 4,661,429 to Molaire et al. The dried film thickness was 10 microns. The performance of this film is summarized in Table I.

COMPARATIVE EXAMPLE 2 (C2)

A film was prepared in the same manner as described in Example 2, except that di-(t-butylphenyl) iodonium triflate was substituted for N-(3-methylphthalimidyl) triflate. The dried film thickness was 13 microns. The performance of this film is summarized in Table I.

COMPARATIVE EXAMPLE 3 (C3)

A film was prepared in the same manner as described in Example 4, except that di-(t-butylphenyl) iodonium triflate was substituted for N-(3-methylphthalimidyl) triflate. The dried film thickness was 10 microns. The performance of this film is summarized in Table I.

COMPARATIVE EXAMPLE 4 (C4)

A film was prepared in the same manner as described in Example 6, except that di-(t-butylphenyl) iodonium triflate was substituted for N-(3-methylphthalimidyl) triflate. The dried film thickness was 8.0 microns. The performance of this film is summarized in Table I.

The following abbreviations are used in Table I:

RATIO=weight ratio of APG/DEA/BINDER in the dried film

APG=acid photogenerator

PVBz=poly(vinyl benzoate-co-vinyl acetate (88/12))

ITf=di-(t-butylphenyl)iodonium triflate

PT-2=phthalimidyl triflate

PT-3=N-(3-methylphthalimidyl)triflate

BPA-PC=bisphenol-A polycarbonate

PNBTA=poly(4-4'-(2-norbornylidene)bisphenol -terephthalate-co-azelate)

TABLE 1

| | | | | 30% Rel. Hum | | 70% Rel. Hum. | | | |
|---|---|---|---|---|---|---|---|---|---|
| EXAMPLE | RATIO | APG | BINDER | Vmax (V) | Fm | Vmax (V) | Fm | ΔVmax (V) | ΔFm |
| C1 | 25/5/70 | ITf | PVBz | +898 | 0.79 | +787 | 0.92 | 111 | .13 |
| 1 | 25/5/70 | PT-3 | PVBz | 858 | 0.82 | 748 | 0.91 | 110 | .09 |
| C2 | 30/5/65 | ITf | PVBz | 914 | 0.70 | 816 | 0.89 | 98 | .19 |
| 2 | 30/5/65 | PT-3 | PVBz | 811 | 0.83 | 650 | 0.90 | 161 | .07 |
| 3 | 30/5/65 | PT-2 | PVBz | 880 | 0.80 | 767 | 0.89 | 113 | .09 |
| C3 | 30/5/65 | ITf | PNBTA | 812 | 0.74 | 673 | 0.87 | 139 | .13 |
| 4 | 30/5/65 | PT-3 | PNBTA | 881 | 0.84 | 816 | 0.86 | 65 | .02 |
| 5 | 30/5/65 | PT-2 | PNBTA | 908 | 0.80 | 858 | 0.88 | 50 | .08 |
| C4 | 30/5/65 | ITf | BPA-PC | 792 | 0.77 | 663 | 0.79 | 129 | .02 |
| 6 | 30/5/65 | PT-3 | BPA-PC | 768 | 0.89 | 760 | 0.92 | 8 | .03 |
| 7 | 30/5/65 | PT-2 | BPA-PC | 760 | 0.87 | 685 | 0.93 | 75 | .06 |

Table I represents a comparison of the performance of the elements of the present invention with elements utilizing an onium salt acid photogenerator (such as those disclosed in U.S. Pat. No. 4,661,429 to Molaire et al.), under varying relative humidities.

The performance of each film was characterized in terms of the equilibrium potentials achieved on the exposed and unexposed areas of the film. The performance of the inventive elements is tabulated in Examples 1-7. The performance of the prior art acid photogenerators is shown at Examples C1, C2, C3 and C4.

"Vmax" is the charge-acceptance or equilibrium potential achieved on an unexposed area of the film. For acceptable performance, Vmax should fall between 600 and 1000 volts (V), and the difference in Vmax between the high and low relative humidity measurements should be less than 200 V. The smaller this difference, the better the performance. "Vmin" is the equilibrium potential achieved on an exposed area of the film. "ΔV"

is the difference between Vmax and Vmin. "Fm" is the ratio of ΔV to Vmax, expressed as:

$$Fm = \Delta V / Vmax.$$

Preferably, Fm should be greater than about 0.70, and the difference between Fm at high and low relative humidity (ΔFm) should be less than 0.10. Again, the smaller the difference, the better the performance.

With the exception of Example 7, the inventive elements each exhibit Vmax values above +700 V and, in all cases, Fm values of 0.80 or greater. The superior performance of the inventive elements relative to the prior art is shown by comparing the ΔFm and ΔVmax values of the comparative examples with the pertinent inventive elements. In each case, the inventive elements show either a smaller ΔVmax or a smaller ΔFm, or both, when compared to the onium salt elements. The elements of Example 4 (N-(3-methyl-phthalimidyl)triflate in a conventional polyester binder) and Example 6 (N-(3-methylphthalimidyl)triflate in a conventional polycarbonate binder) show especially good performance. These Examples exhibit the least variation in Vmax and Fm with respect to relative humidity among all the Examples.

The onium salt elements generally suffered from a high ΔFm when exposed to different relative humidities, as shown by the ΔFm values of 0.13, 0.19 and 0.13 respectively for Examples C1, C2 and C3. This problem was not seen in the inventive elements, all of which had ΔFm values of less than 0.10.

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A photoelectrographic element for electrostatic imaging which is capable of producing multiple prints from a single exposure and exhibiting consistent performance at variable relative humidities, said element comprising:

a conductive layer in electrical contact with an acid photogenerating layer which is free of photopolymerizable materials and comprises an electrically insulating binder and a nonionic sulfonic acid photogenerator.

2. Photoelectrographic element according to claim 1, wherein the nonionic sulfonic acid photogenerator is a sulfonate ester of N-hydroxyamide or N-hydroxyimide.

3. A photoelectrographic element according to claim 2, wherein the nonionic sulfonic acid photogenerator is a N-phthalimidyl triflate.

4. A photoelectrographic element according to claim 3, wherein the nonionic sulfonic acid photogenerator is selected from the group consisting of N-(1,8-naphthalimidyl) triflate, N-phthalimidyl triflate, and N-(3-methylphthalimidyl) triflate.

5. A photoelectrographic element according to claim 1, wherein the binder is selected from the group consisting of polycarbonates, polyesters, polyolefins, phenolic resins, paraffins, mineral waxes and aromatic esters of a polyvinyl alcohol polymer.

6. A photoelectrographic element according to claim 1, wherein the binder is selected from the group consisting of poly(vinyl benzoate-co-vinyl acetate), bisphenol-A polycarbonate, and poly(4,4'-(2-norbornylidene)bisphenolterephthalate-co-azelate.

7. A photoelectrographic element according to claim 1, wherein the binder is present in a concentration in the range of 55 to 80 weight percent.

8. A photoelectrographic element according to claim 1 further comprising:

a near-ultraviolet radiation absorbing sensitizer.

9. A photoelectrographic element according to claim 8, wherein the near-ultraviolet radiation absorbing sensitizer is selected from the group consisting of xanthones, indandiones, indanones, throxanthones, acetophenones, benzophenones, anthracenes, dialkoxyanthracenes, perylenes, phenothiazines, and pyrenes.

10. A photoelectrographic element according to claim 1, wherein the conductive layer comprises a polyester coated with a thin electroconductive layer of cuprous iodide.

11. A photoelectrographic element according to claim 1 further comprising:

a barrier layer.

12. A photoelectrographic element according to claim 1, wherein said nonionic sulfonic acid photogenerator is present in a concentration in the range of 15 to 40 weight percent.

13. A photoelectrographic method for printing using a photoelectrographic element comprising a conductive layer in electrical contact with an acid photogenerating layer which is free of photopolymerizable materials and comprises an electrically insulating binder and a nonionic sulfonic acid photogenerator and exhibits consistent performance at variable relative humidities, said method comprising:

exposing the acid photogenerating layer imagewise to radiation without prior charging to create a permanent latent conductivity pattern and printing an image from the latent conductivity pattern, said printing comprising:

charging said element with the acid photogenerating layer having a latent conductivity pattern to create a electrostatic latent image;

developing the electrostatic latent image by applying charged toner particles to said element to produce a toned image; and transferring the toned image to a suitable receiver, wherein said printing is carried out one time for each print made.

14. A method according to claim 13, wherein the nonionic sulfonic acid photogenerator is a sulfonate ester of N-hydroxyamide or N-hydroxyimide.

15. A method according to claim 14, wherein the nonionic sulfonic acid photogenerator is a phthalimidyl triflate.

16. A method according to claim 15, wherein the nonionic sulfonic acid photogenerator is selected from the group consisting of N-(1,8-naphthalimidyl) triflate, phthalimidyl triflate, and N-(3-methylphthalimidyl) triflate.

17. A method according to claim 13 further comprising:

cleaning any residual toner particles not transferred to the receiver from the element for each print made.

18. A method according to claim 13, wherein the receiver is a substrate for permanently receiving a toned image as a print.

19. A method according to claim 13, wherein the receiver is a means suitable as an optical master or an overhead transparency.

20. A photoelectrographic element for electrostatic imaging which exhibits consistent performance at variable relative humidities comprising a conductive layer in electrical contact with an acid photogenerating layer which is free of photopolymerizable materials and comprises:

an electrically insulating binder selected from the group consisting of polycarbonates, polyesters, polyolefins, phenolic resins, paraffins, mineral waxes and aromatic esters of a poly(vinyl alcohol) polymer;

a nonionic sulfonic acid photogenerator selected from the group consisting of the sulfonate esters of the N-hydroxyamides and N-hydroxyimides; and a near-ultraviolet radiation absorbing sensitizer selected from the group consisting of xanthones, indandiones, indanones, throxanthones, acetophenones, benzophenones, anthracenes, dialkoxyanthracenes, perylenes, phenothiazines, and pyrenes; wherein said element has a ΔFm value less than about 0.10.

21. A photoelectrographic element according to claim 1, wherein said element has a ΔFm value less than about 0.10.

22. A photoelectrographic method according to claim 13, wherein said element has a ΔFm value less than about 0.10.

* * * * *